US006048043A

United States Patent [19]

Kaspar

[11] Patent Number: 6,048,043

[45] Date of Patent: Apr. 11, 2000

[54] KNOCK-DOWN KIOSK

[76] Inventor: Bryce C. Kaspar, 510 W. College Ave., Salisbury, Md. 21801

[21] Appl. No.: 09/079,461

[22] Filed: May 15, 1998

[51] Int. Cl.[7] ..... A47B 81/00

[52] U.S. Cl. ..... 312/223.3; 312/258; 312/196

[58] Field of Search ..... 312/258, 223.3, 312/239, 194, 195, 196

[56] References Cited

U.S. PATENT DOCUMENTS

| | | | |
|---|---|---|---|
| 2,141,117 | 12/1938 | Weiss . | |
| 2,581,251 | 1/1952 | Glazer et al. . | |
| 2,631,915 | 3/1953 | Wintersteen . | |
| 3,160,451 | 12/1964 | Lewis | 312/239 X |
| 3,233,346 | 2/1966 | Cornberg . | |
| 3,251,985 | 5/1966 | Krupnick . | |
| 3,338,002 | 8/1967 | Ericsson et al. . | |
| 3,559,814 | 2/1971 | Downing | 312/258 X |
| 3,592,289 | 7/1971 | Ayde et al. . | |
| 3,634,674 | 1/1972 | Tuttle . | |
| 4,179,723 | 12/1979 | Spencer . | |
| 4,414,609 | 11/1983 | Shemitz . | |
| 4,436,353 | 3/1984 | Tucker | 312/258 X |
| 4,478,467 | 10/1984 | Tyndall | 312/258 X |
| 4,580,776 | 4/1986 | Burkinshaw | 312/258 X |
| 4,874,027 | 10/1989 | Boundy et al. . | |
| 5,036,436 | 7/1991 | Rattigan et al. . | |
| 5,546,316 | 8/1996 | Buckley et al. . | |
| 5,550,746 | 8/1996 | Jacobs . | |
| 5,664,854 | 9/1997 | Letch | 312/258 X |
| 5,842,758 | 12/1998 | Kelley | 312/196 |

*Primary Examiner*—Peter M. Cuomo
*Assistant Examiner*—Stephen Vu
*Attorney, Agent, or Firm*—Connolly Bove Lodged Hutz, LLP

[57] ABSTRACT

A knock down kiosk is in the form of a trapezoid having a back wall and diverging side walls all of equal length. The trapezoid is open at its front to permit users to enter the kiosk. A floor, a lower front panel, a countertop and a roof are detachably mounted to the walls. The various components may be stored in a compact condition.

32 Claims, 14 Drawing Sheets

Fig. 3.
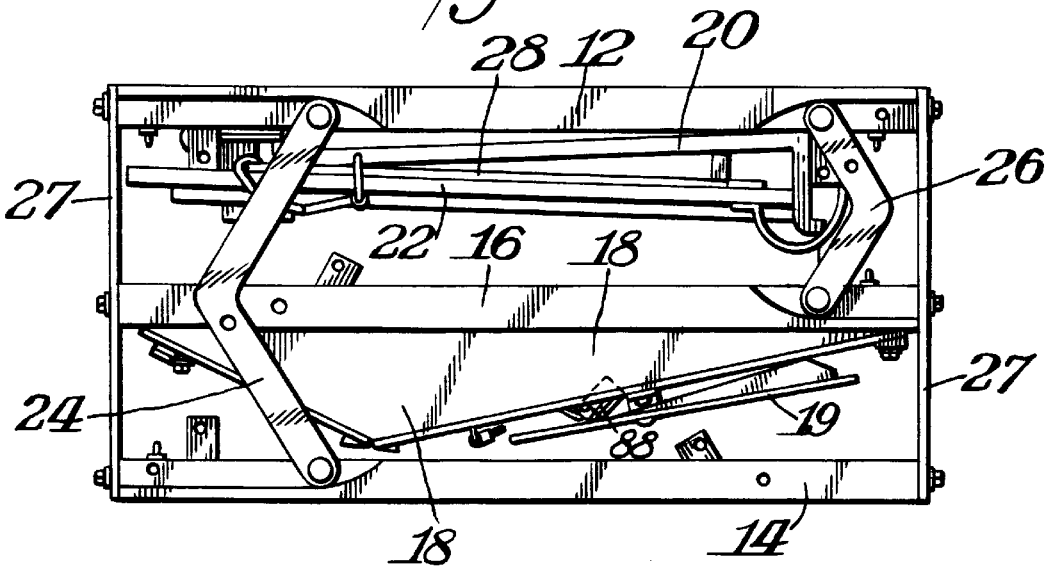
Fig. 4.
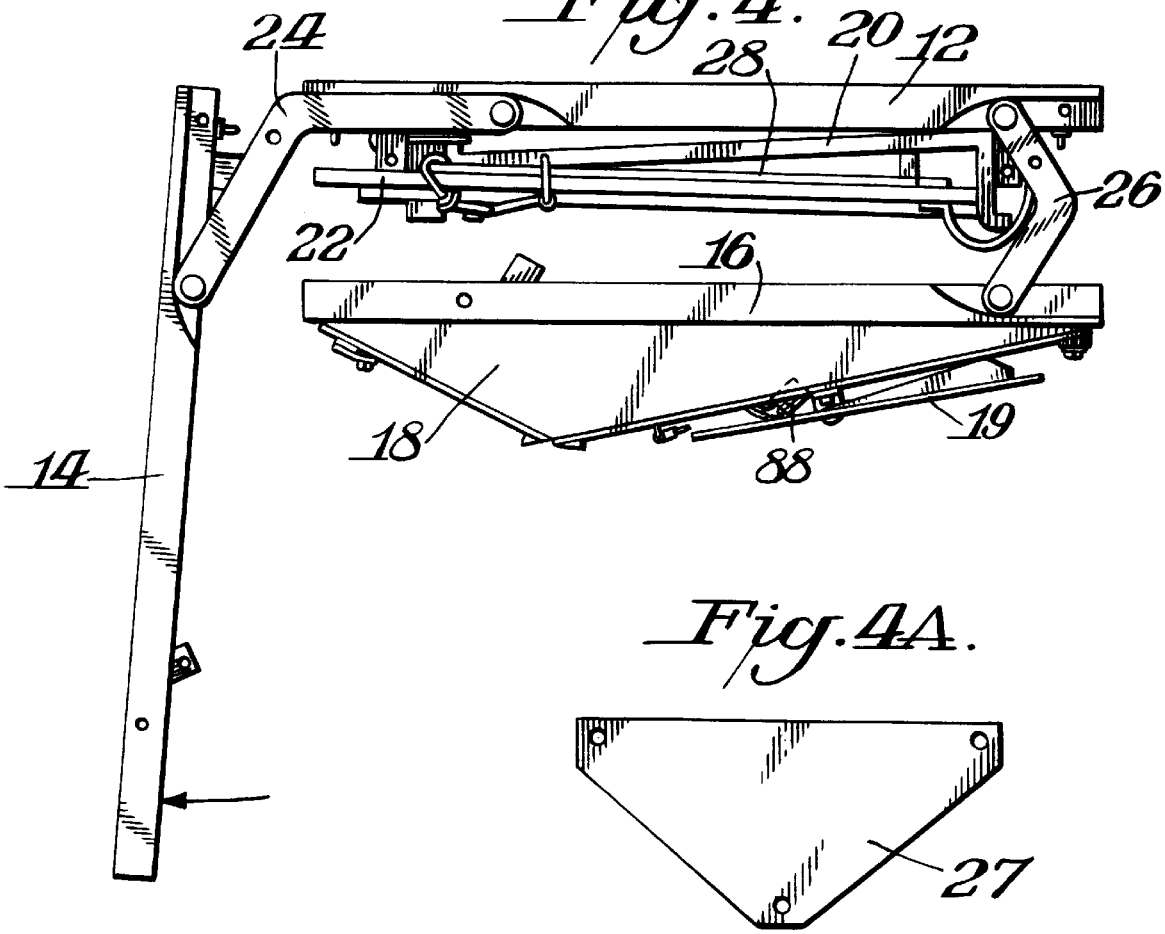
Fig. 4A.

14

16
12
18
28
20
36
30
32
19
34
64
70
30
36
22
118
58
38
40

76
28
20
96
56
64
70
73
72
84
78
62
74
80
82
58
122
40

112

10
14
12
16
18
86
108
104
116

KNOCK-DOWN KIOSK

BACKGROUND OF THE INVENTION

Kiosks or shells are frequently used as a temporary office or store frequently in connection with the sales or displays of products or the dissemination of various information. A common location for such kiosks is in shopping malls. Ideally, a kiosk should be easy to assemble and disassemble. In addition, advantage should be taken of various facilities at a shopping mall such as lighting. For example, shopping mall's lighting is most likely high efficiency (sodium or mercury vapor lamps) giving objects in the mall a yellowish or greenish-blue hue. The hard walls and large spaces of the mall give the sound field a high frequency 'edge' and a long time-period reverberance. The human psyche interprets these cues as reasons to keep moving (looks cold/unnatural) and to be alert to the surroundings (open area, open to attack by predator). This detracts from the human's ability to concentrate on a detailed presentation.

Sales kiosks in malls and fast food restaurants use these cues to encourage the customer to buy and keep moving. In their cases, short customer stays mean higher profits.

However, many commodities, such as places to live, need time for assessment and contemplation. While having a sales person present at a kiosk may make the potential customer feel more secure with the surroundings, they may also feel pressure from the sales person, and move on before having assessed and contemplated the information the advertiser wants to put before them.

Goods and services may be looked at in many different ways. Houses may be looked at for price, appearance, location, style, size, number of bedrooms, size of living room, trees in back yard, etc. Architects, builders, landscapers, and home improvement contractors may be looked at for capability, style preferred, materials used, and the appearance of finished projects. Tailors, dress makers, and clothing designers are looked at for their style, quality, cost, and location. Exotic car dealers, gourmet food stores, fine restaurants, and travel agents all have attributes of which advertisers would like the public to be aware. The problem has been: How to inform the public.

Conventional advertising has drawbacks: In print (visual), too many or too big ads will bury the customer in unwanted data, too few or too brief ads will deprive the customer of information needed, and wide area distribution of ads is expensive and wasteful of paper and ink. Radio (audio) cannot show goods. Television (audio/visual) is expensive for the exposure given. The on-line computer (visual/interactive) is slow to show pictures and text, and distributes information far beyond the area the advertiser can serve. Further, none of these means of advertising allows the user to talk with the advertiser as part of the service.

Part of the answer is a multi-media device, able to store vast quantities of pictures and data, but only showing the customer pictures and information that meet the customer's needs. As the customer is in control, the customer can request and be given a detailed presentation. The problems with this are two: 1) The device ought to be in a quiet, secluded place so that the customer can concentrate on and consider the information presented; and 2) The customers need to have a way to talk with the sponsor of the presentation if they have questions or wish to buy.

SUMMARY OF THE INVENTION

An object of this invention is to provide a kiosk particularly useful as a standing height shell for a multi-media device.

A further object of this invention is to provide a kiosk in knock-down form so that it can be easily assembled and disassembled.

In accordance with this invention the kiosk is in the form of a shell having three walls of equal width arranged as a trapezoid with the wide side open. The shell may have a roof for an interactive multi-media device, acoustically incorporating a speaker-phone and designed so that a lone person can dismount, store and move the shell. Preferably, the shell has a standing height countertop abutting the back and side walls but of lesser depth than the side walls, yet, wide enough to allow two people to use an interactive multi-media display mounted in the countertop.

The depth and width of the shell block the user's view of the shell's environment, allowing them to concentrate on the multi-media presentation. The shell's lights may be of a warm color-temperature making the interior seem friendly and inviting. The inner wall surfaces are sound absorbent so that the user can clearly hear the presentation and its sound field. The acoustical design allows a speaker-phone operatively associated with the multi-media device to enable the user to talk with the sponsor of the presentation, even in a noisy environment.

The shell's three walls pivot on unequal length hinging members to make a stack with spaces between the panels for the storage of the non-wall components (countertop, front panel, inner floor, and roof). The stack of panels can be put in storing configuration by a lone person and can be moved on a hand-truck.

The present invention thus relates to a standing height shell for a multi-media device. It is designed to give the view of the multi-media presentation a sense of space different from the environment, more interior and quieter in which to view and contemplate the presentation. It may have a speaker-phone built-in designed to be operatively associated with the multi-media device, and to allow the user to talk with the sponsor of the presentation even in a noisy environment.

The invention is thus designed to give the user the experience of an inviting and more intimate visual and acoustic 'space' even though the user has moved only a short distance from the mall's 'space' to the kiosk's counter. The perspective effect of the walls and trapezoidal ceiling give the impression of an interior space much deeper than the countertop. Sound absorbent wall surfaces and stereo speakers in the back wall of the shell give the sonic impression of a close space, separate from the mall.

The speaker-phone speaker is located in the top center of the back wall so that in conversation with the sponsor, the sponsor's voice comes from on high. This not only lends authority to the sponsor's words, but also it encourages the user to speak upwardly into the directional speaker-phone microphone built into the inside of the shell's roof.

THE DRAWINGS

FIG. 3 is a top plan view of the kiosk show n in FIGS. 1–2;

FIG. 4 is a top plan view of the kiosk shown in FIGS. 1–3 in the first stage of being assembled;

FIG. 4A is a front elevational view showing a retainer plate used with the kiosk of FIGS. 1–4;

Figure 15:
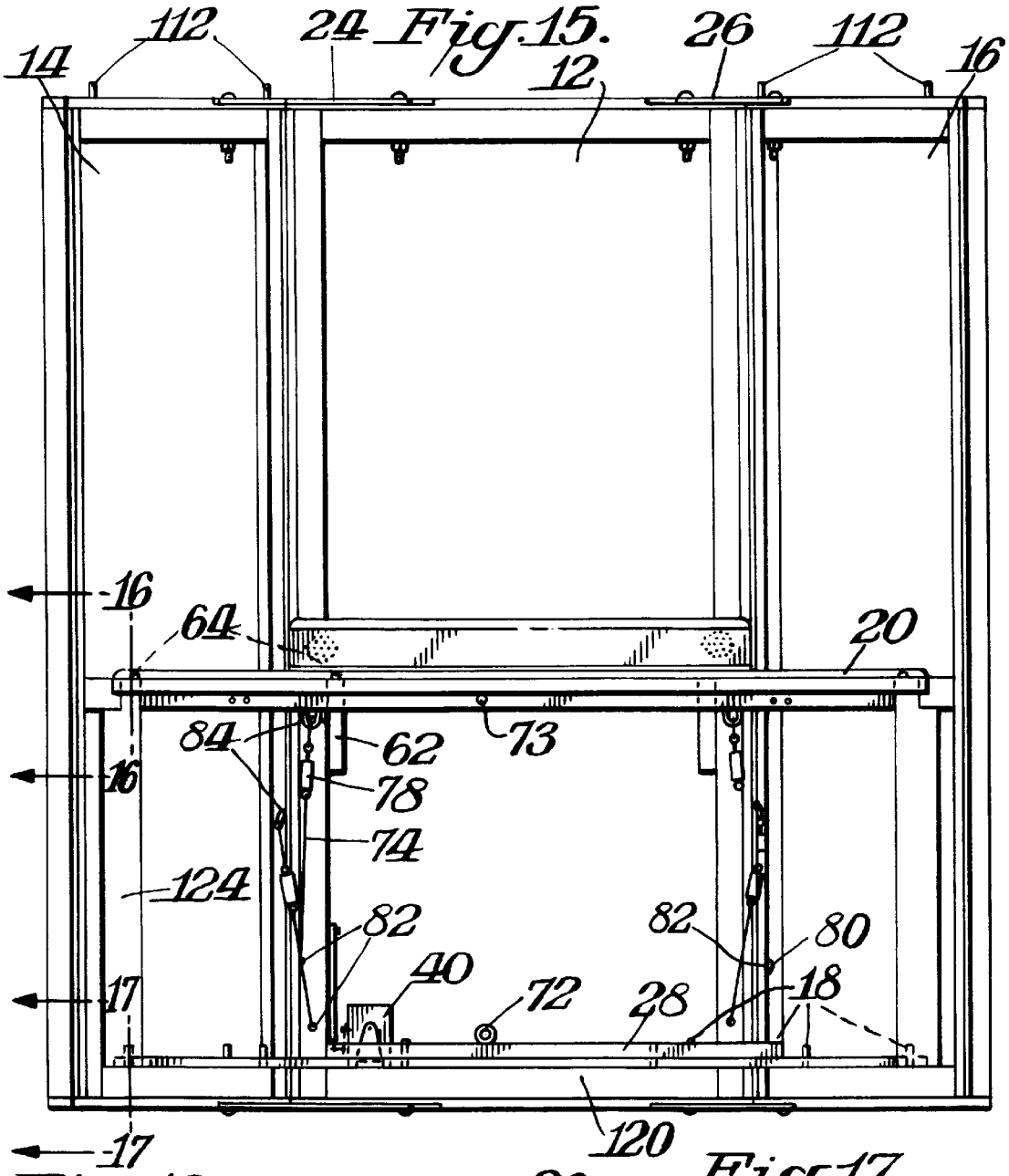
FIG. 15 is a front elevational view of the kiosk in a further stage of assembly.
Figure 16:
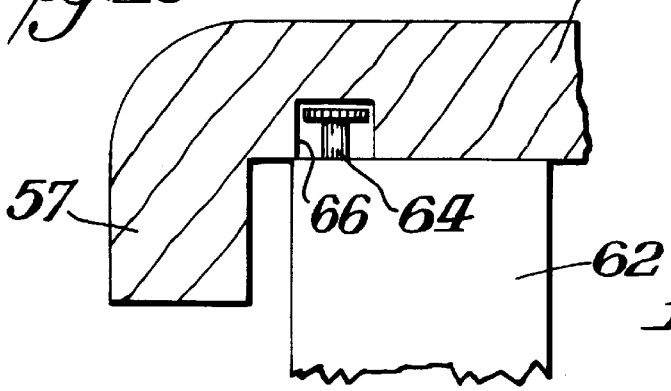
Figure 17:
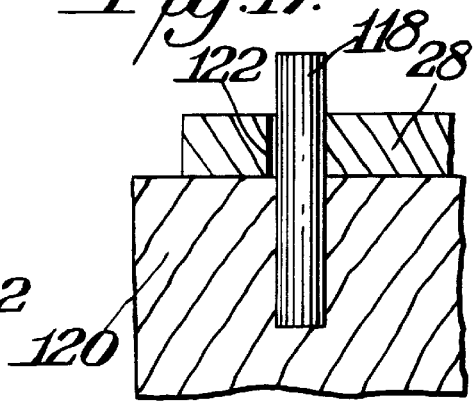
Figure 18:
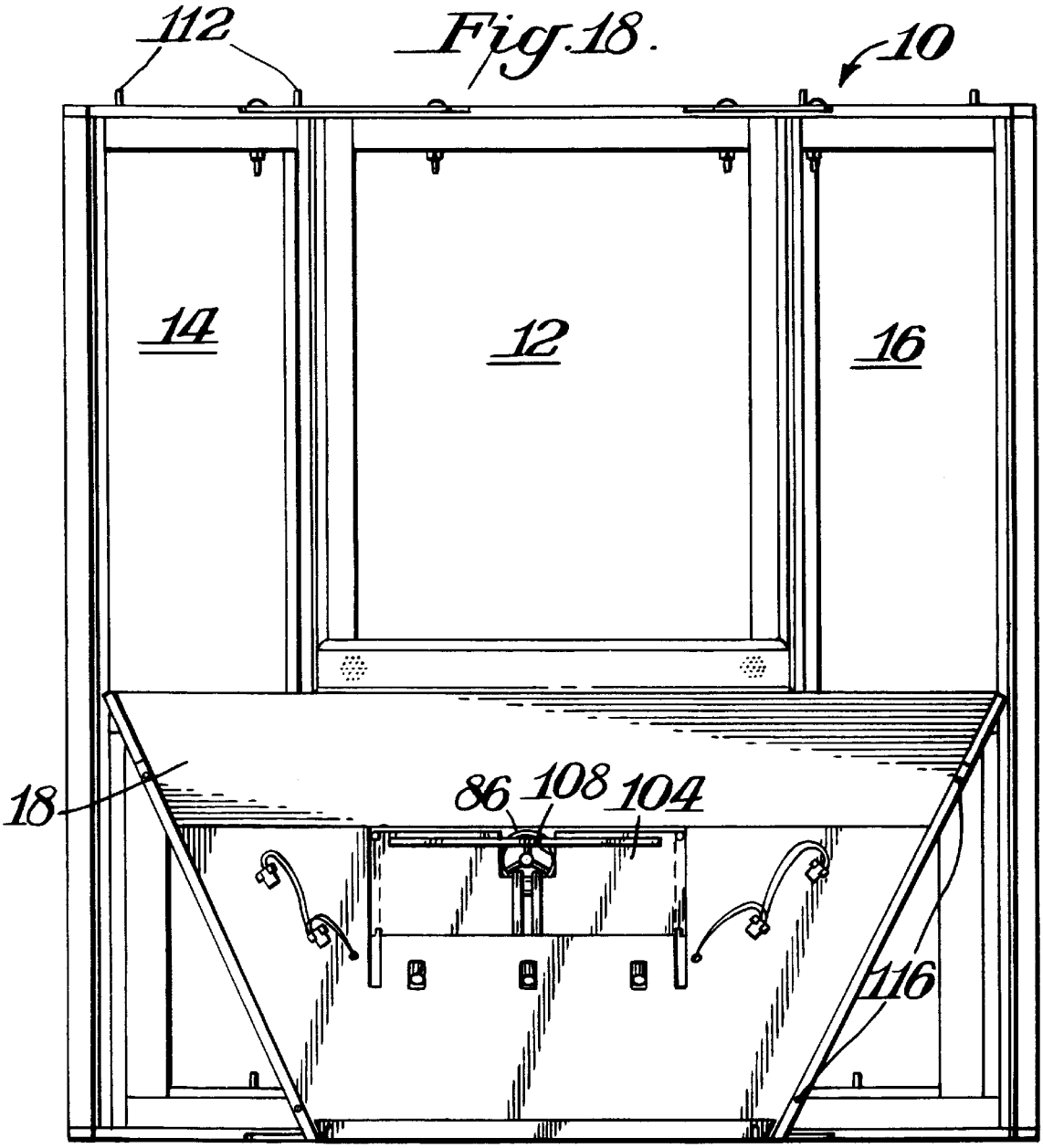
Figure 19:
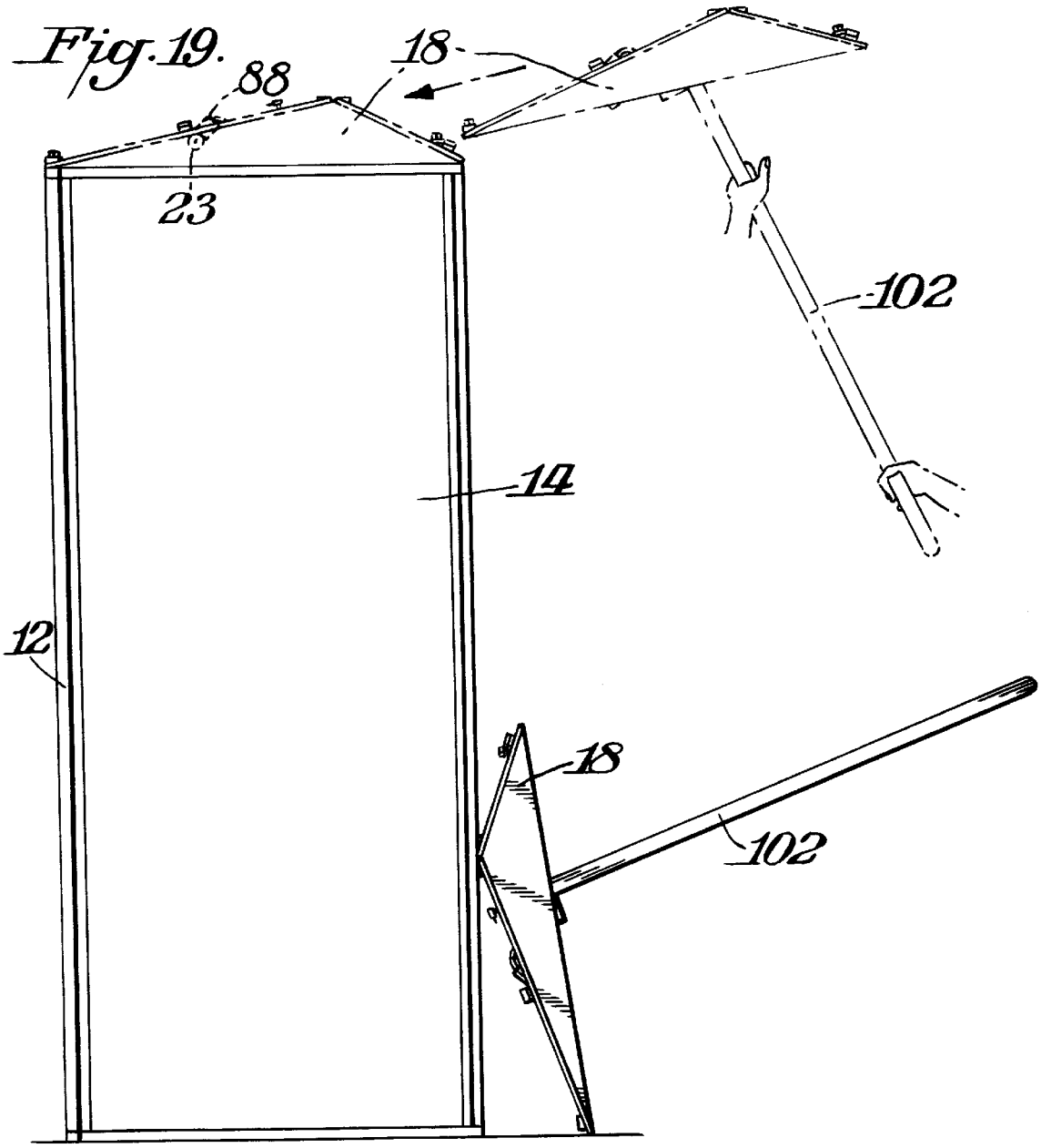
Figure 19A:
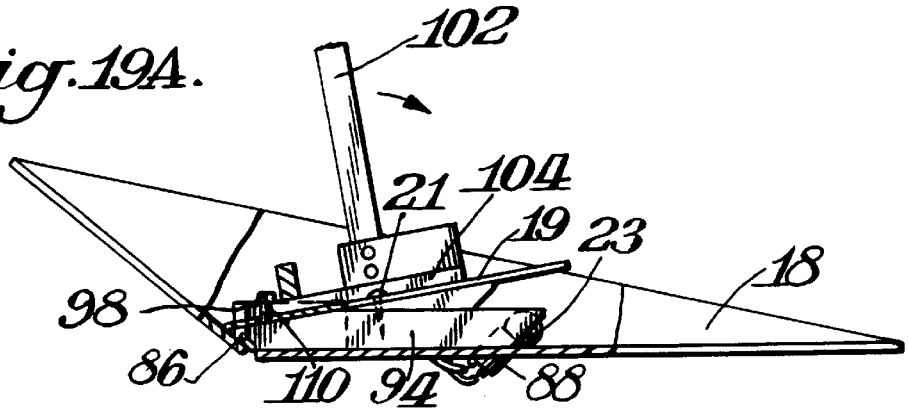
Figure 20:
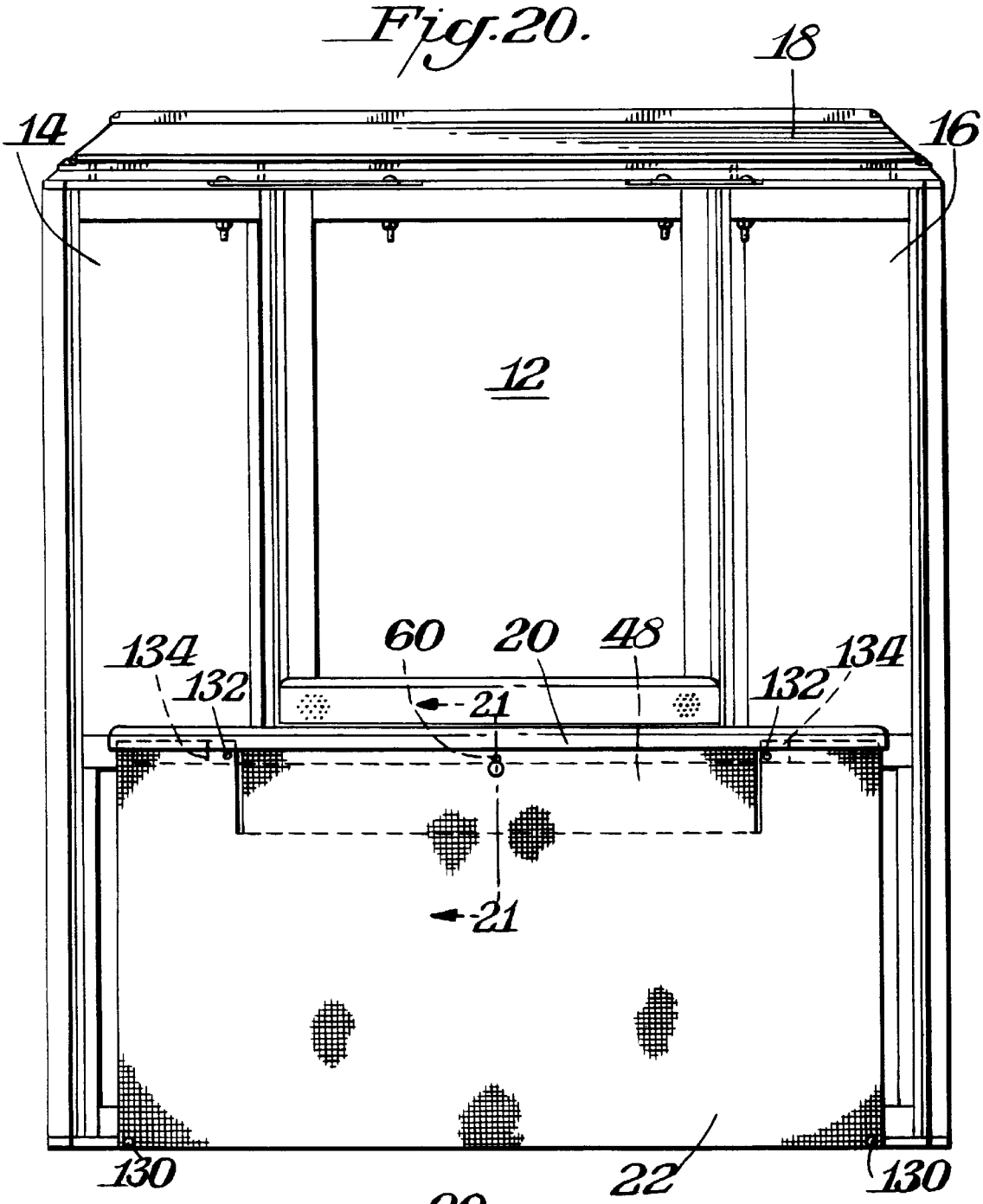
Figure 21:
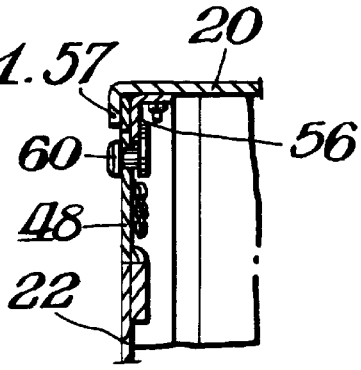
Figure 22:
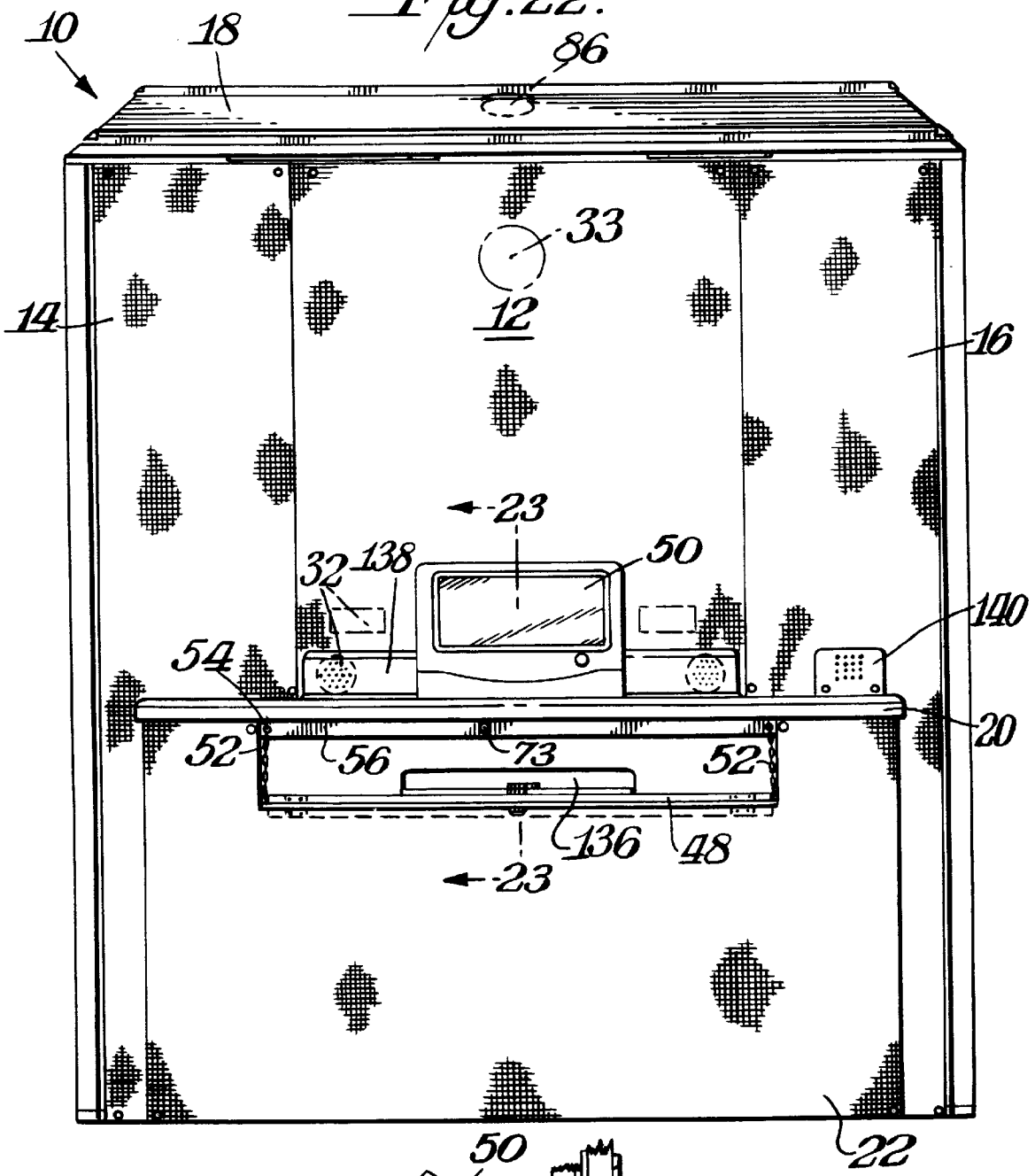
Figure 23:
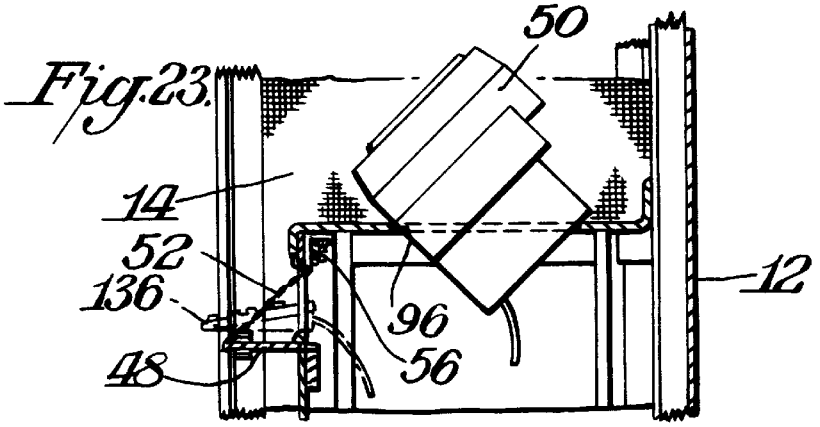

FIGS. 16 and 17 are cross-sectional views taken through FIG. 15 along the line 16—16 and 17—17;

FIG. 18 is a front elevational view showing the kiosk in its totally open condition before assembly of the roof in accordance with this invention;

FIG. 19 is a right side elevational view showing the mounting of the roof on the kiosk of this invention;

FIG. 19A is an enlarged side elevational view showing engagement of the lifter and the roof for the mounting of FIG. 19;

FIG. 20 is a front elevational view of the kiosk of this invention with the roof mounted in place;

FIG. 21 is a cross-sectional view taken from FIG. 20 along the line 21—21;

FIG. 22 is a front elevational view of the kiosk in its fully assembled condition; and FIG. 23 is cross-sectional view taken through FIG. 22 along the line 23—23.

DETAILED DESCRIPTION

Although the present invention is particularly useful as an interactive multi-media device, the invention in its broad aspect relates to a kiosk or shell which could be used for other purposes such as a computer work station, an educational carrel, a phone booth or a portable/temporary structure for any purpose. The following are some of the aspects which may be incorporated in the invention. In the following description the structure will be referred to as a kiosk. It being understood, however, that the term kiosk is intended to apply to any such structure as noted above.

In the following description where reference is made to various components incorporated in the kiosk it is to be understood that such components are preferred for their particular end use but need not be used where the kiosk has other purposes. Thus, such preferred components should be considered optional.

The kiosk is a roofed shell with one back and two open angled side walls of equal widths. The vertical surfaces are sound absorbent. It has a standing height countertop which is not as deep as the side walls. The inside of the roof has baffled lights so that the wall surfaces and their decor are illuminated, but there is no direct lighting on the counter-top or user. The face of a user, standing next to the counter top, is inside the shell, and subject to its visual and sound fields. The shell is wide enough to comfortably accommodate two users at the same time.

The countertop houses a multi-media display screen recessed at about 45 degrees into the counter-top for display of information about goods/services. Two speakers are built into the back panel at the ends of, and just above, the counter-top for audio to go with the visuals on the display screen. Alternatively, or in addition, one or more speakers could be at the counter blacksplash.

A speaker-phone is operatively associated with the multi-media device so that an interested customer can talk with the sponsor of the information displayed. The speaker for the speaker-phone is built into the center-top of the back panel, so that users of the speaker phone will tend to lift their heads to hear the speaker more clearly, and will tend to speak upwardly toward the microphone. If desired, although not as preferred, the speaker phone could be on the countertop.

The microphone of the speaker-phone is highly directional, and mounted in the roof, somewhat in front of the user's mouth, aiming down at the user's mouth. As most noise will be from sources horizontal to the shell, the walls of the shell will dampen this. The user will block vertical noise bouncing off the floor directly at the microphone, and the microphone's directional sound pattern will damp off-axis noise. This will allow the customer to be clearly heard, even in a high ambient noise environment.

The screen and associated devices dismount from the countertop to be transported in their own case.

The shell roof, countertop, front or lower panel and inner floor, dismount from the shell walls. The countertop, front panel and inner floor mount vertically on the inner face of the back panel for shipping. One side wall pivots/hinges around to be parallel with the back wall using a wide V shaped link or hinge. The roof mounts to the outside of this wall. The other wall pivots/hinges around to be parallel with the first wall and back wall, using an even longer V shaped link. This resulting 'stack' of spaced panels creates a shipping container light and compact enough to be transported by an individual with a hand truck.

The 3 wall panels pivot on hinging members to change from kiosk function to shipping configuration, becoming either:

1) A multi-media kiosk with sound absorbent interior panels and a roof such that environmentally ambient sound and ambient lighting/visuals are substantially reduced. The kiosk sound and lighting conveys a sense of a warm, 'friendly', enclosed space. This allows the user to more easily see, hear, and concentrate upon the information presented by the multi-media device contained in the kiosk. To allow voice communication with a remote sponsor during high ambient noise, the kiosk has a speaker phone operatively associated with the acoustic design of the side and roof panels, with its microphone vertically oriented to block reception of noise sources horizontal to the kiosk, and incorporating the user as a sound absorbent element to block vertical noise sources.
2) Additionally, a series of 3 fixed parallel panels have spaces between them. These spaces provide means for the storage of all the non-wall panels and the roof. The assembly can be set up, taken down, and moved by a lone person of average size, strength, and intelligence using a hand truck. This assembly is narrow enough to easily fit through any standard doorway. It can be transported in a large station wagon, or a small van, or a pick-up truck.

As noted a preferred use of the kiosk is for the display of houses, but it can be used for many other products and services.

An interior space is experientially defined by a set of visual and sound field cues. As this device may well be set up in a mall, let us consider the differences in visual and sound fields.

As noted, shopping mall's lighting is most likely high efficiency (sodium or mercury vapor lamps) giving objects in the mall a yellowish or greenish-blue hue. The hard walls and large spaces of the mall give the sound field a high frequency 'edge' and a long time-period reverberance. The human psyche interprets these cues as reasons to keep moving (looks cold/unnatural) and to be alert to the surroundings (open area, open to attack by predator). This detracts from the human's ability to concentrate on a detailed presentation.

Sales kiosks in malls (Gold by the Inch, Country Style Decor, Cell Phones to GO, and such like) are open to the mall's light and sound, and are experientially part of the mall. Fast food restaurants also use these cues to encourage you to buy and keep moving. In their cases, short customer stays mean higher profits.

However, many commodities (such as houses or other places to live) need time for assessment and contemplation. While having a human (sales person) present at a kiosk in the mall may make the customer feel more at ease with the surroundings, they may now feel threat of attack from the sales person ("I know just what you need, and its ONLY . . . ").

The alternatives for the seller are newspaper or television ads, the former giving poor display of the product, the latter having a relatively small audience, and both requiring the customer to talk to a sales person to learn anything more. Further, neither can tell the advertiser how many customers saw the product, and what they thought of it.

The kiosk of this invention is designed to give the user the experience of an inviting and more intimate visual and acoustic 'space' even though the user has moved only a short distance (a foot or two) from the mall's 'space' to the kiosk's counter.

A touch screen video monitor built into the countertop of the kiosk allows even the new user to easily tell the kiosk what the user wants to see; in the case of houses, at about what price, with how many bedrooms, in what area, etc. The device serving the touch screen can now show the user multi-media presentation(s) of products that meet their requirements. If the user wants to talk with someone about the product, just a touch on the telephone icon will cause the host device to connect the user to the seller via a speakerphone designed for the high ambient noise environment of a mall.

As an intelligent agent the kiosk can greet and interact with customers/clients, allow them to ask for and see/hear information keyed to their specific needs/desires, and talk with a person who can help them, if they so desire. With appropriate technology (card swiper, etc.), purchases can be ordered directly.

As there is no staff at the kiosk, 3 classes of people will benefit:

a) Customers/clients, having no sense of sales pressure, can feel free to browse. They can call staff with a finger touch if they feel the need.

b) Management, because staffing expenses are reduced.

c) Staff, because all staff want first contacts made, but no one wants to be the one doing it. The person making contacts at a staffed kiosk is not the person cashing in one them.

Management will also be pleased that the kiosk can be dismantled by one person of average strength and intelligence, forming its own shipping cases, and requiring no specialized equipment. The entire unit may be moved by one person in a large station wagon, a mini-van, or a small pickup truck. Usually, devices of this type require specialized moving staff and vehicles, with attendant scheduling problems and expense. The kiosk could be at the mall during the week for regular business, and at the civic center for a trade show during the weekend, with no extra expense.

Advantages of the kiosk include:

a) the high ambient noise speaker phone capability;

b) use of visual field and sound field to demark an enclosed virtual space;

c) the kiosk's self storing capability; no carrying cases;

d) the kiosk's one person set up/take down; and e) the kiosk's regular vehicle portability.

FIG. 22 illustrates a kiosk 10 in accordance with this invention in its assembled form. As shown therein, kiosk 10 is in the form of a trapezoidal shaped shell having a back wall 12 and a pair of side walls or wings 14,16 which extend from back wall 12 and diverge away from each other. The fourth side of the trapezoid is open to create an entranceway for users. As also shown therein the shell includes a roof 18 and a counter 20 with a lower panel or front wall 22 extending below countertop 20. As later described various equipment is included in kiosk 10.

Figure 1:
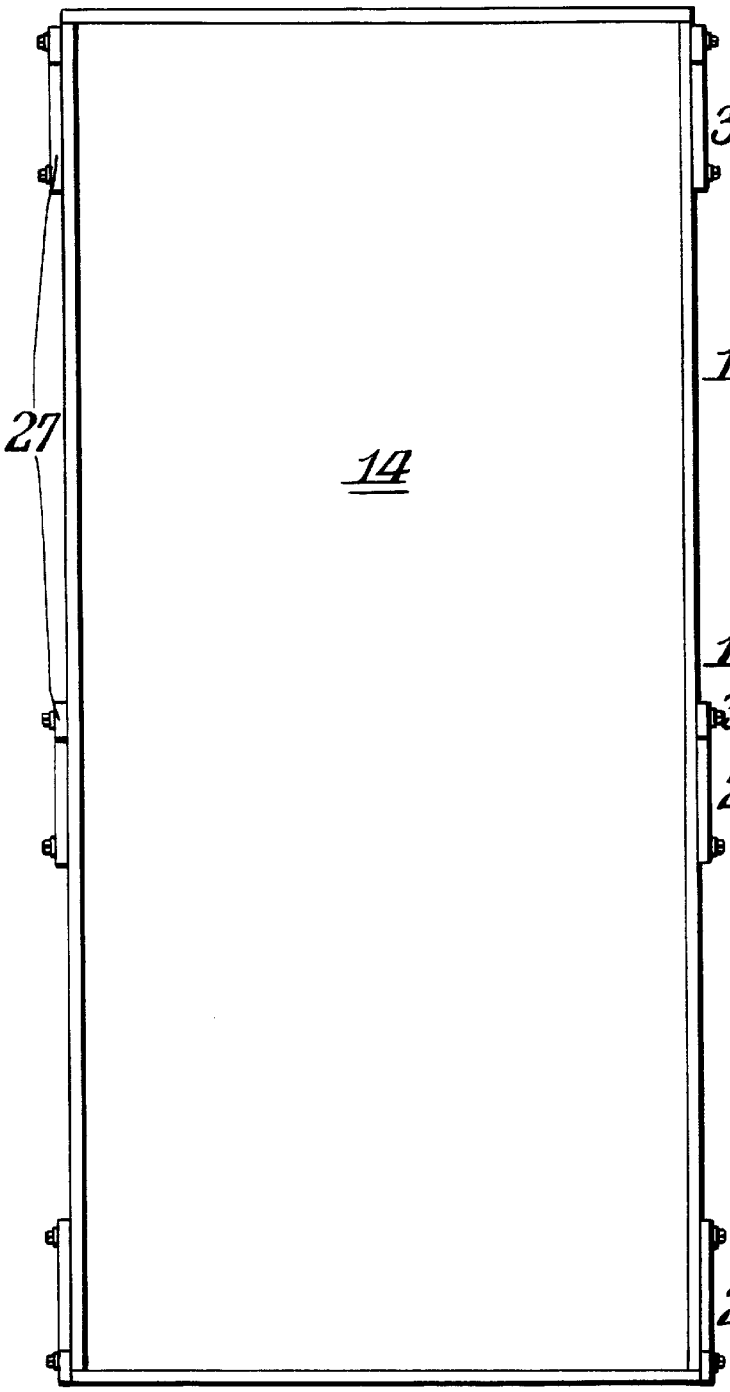
FIG. 1 is a front elevational view showing a knock-down kiosk in its closed condition in accordance with this invention.
Figure 2:
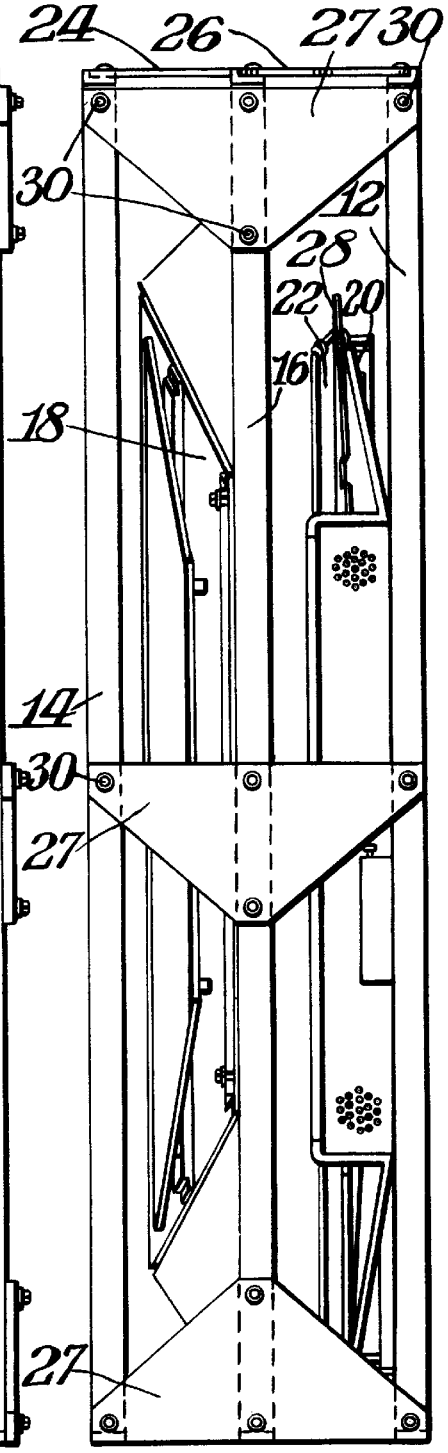
FIG. 2 is a side elevational view of the kiosk shown in FIG. 1.

Reference is now made to various figures which show the sequence of assembling kiosk 10 for its condition of use. FIGS. 1–3, for example, illustrate the kiosk 10 in its knock down or stored condition. As shown therein the walls 12,14,16 are of the same shape and dimension and are secured together by hinge structure. It is to be understood that there could be some minor difference in the size or shape such as making one of the walls shorter and filling the space with a separate spacer piece. Thus, the reference to generally the same size and shape is intended to include such variations. As illustrated, a hinge 24 connects wing or wall 14 with back wall 12 while a smaller hinge 26 connects wing or side wall 16 with back wall 12. These hinges are unique in their incorporation in the invention as will later be discussed.

As best illustrated in FIG. 2 the three walls 12,14,16 are held in their knock down stored condition parallel to each other by means of retainer plates 27 secured to each wall by any suitable fastener such as screws 30. Preferably plate 27 includes four holes for four screws. This prevents parallelogram distortion during shipping. As illustrated in FIGS. 2 and 3 an open space is formed on each side of central wall 16. Various components for the kiosk are stored in these two open spaces during conditions of non-use when the kiosk is in its knock down position.

FIG. 4 illustrates kiosk 10 after the plates or brackets 27 have been removed. As shown in FIG. 4 wing 14 has been pivoted outwardly. FIG. 4 also illustrates that each end of large, generally V-shaped hinge 24 is mounted inwardly of the corner that will result from walls 14 and 12 generally abutting each other. In the condition shown in FIG. 4 the roof 18 is exposed as it is disposed against the right wing or panel 16. The panel 22, floor 28 and countertop 20 remain in the space between panels or walls 12 and 16. FIGS. 3–4 also illustrate the roof 18 to include a light shield 19 which would be disposed below the lightbulbs 23 in sockets 88 so as to create indirect lighting when the roof is installed on the kiosk. Thus, the bulbs 23 do not shine directly on the user in the kiosk and instead indirect lighting is created.

Figure 5:
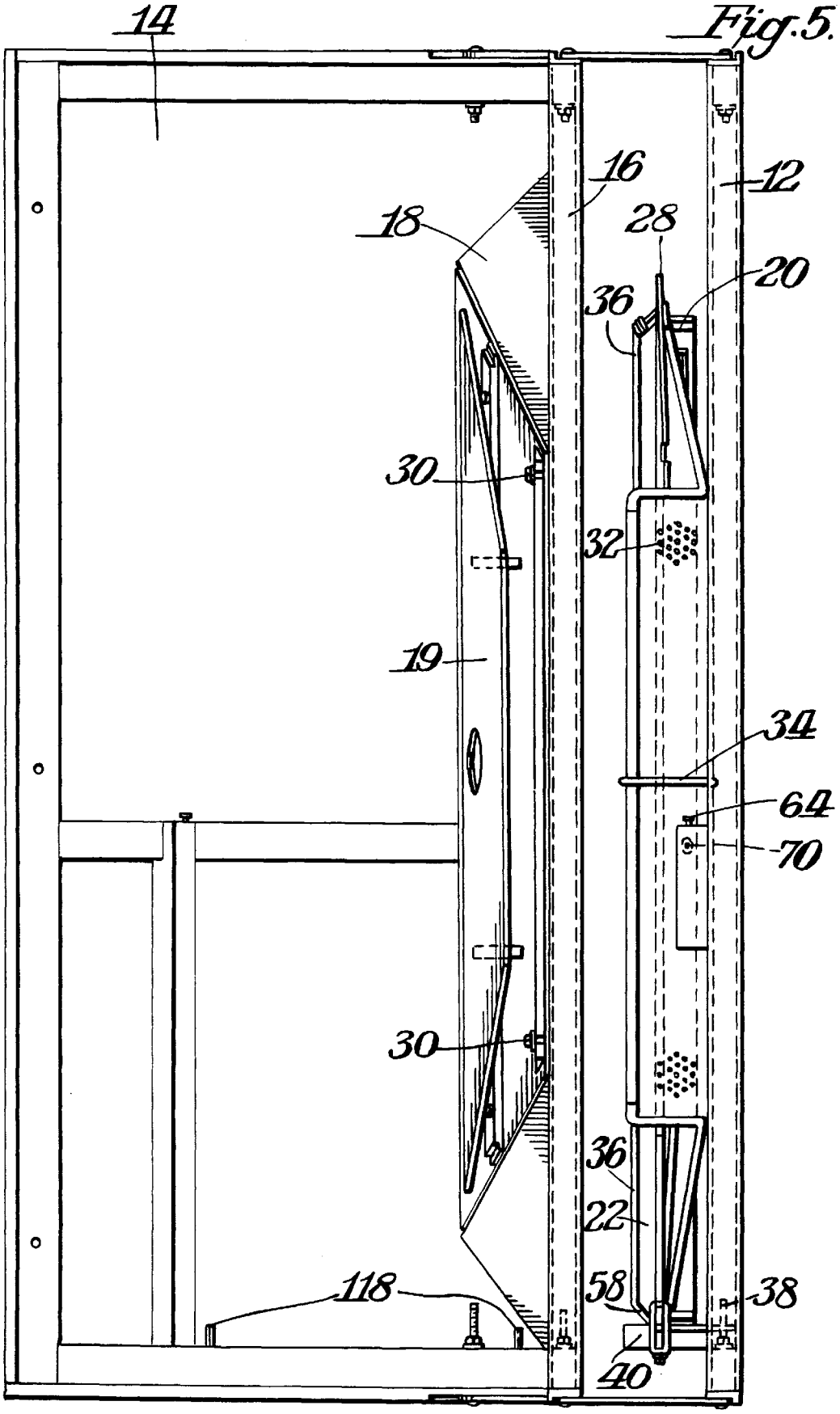
FIG. 5 is a right side elevational view of the kiosk shown in FIG. 4.

FIG. 5 illustrates the roof 18 to be mounted against wing 16 by means of any suitable fasteners such as bolts 30. As also shown in FIG. 5 the countertop 20 and floor 28 and lower panel 22 are held against back wall 12. FIG. 5 illustrates the countertop 20 to include speaker holes 32. Speakers, however, could be at any suitable location. The countertop 20 and floor 28 and lower panel 22 are secured together against back wall 12 by various fastening arrangements. For example, FIG. 5 illustrates a spring clamp 34 of generally C-shape extending around front or lower panel 22 and then around floor 28 and then around countertop 20. The ends of spring clamp 34 are located in front of back panel 12 as shown for example in FIG. 8. Elastic shock cords 36 are looped over the peak of floor 28 at one end and extend downwardly around front panel 22 and extend around pin 38 secured to back panel 12. Instead of elastic cords and C-clamps, nylon belting and a sliding presser foot could be used as the cord and anchor members. A support block 40 is also secured to back panel 12. Support block 40 has a slot into which the edge of floor 28 is inserted. The adjacent edge of countertop 20 also rests in the slot in block 40.

Figure 6:
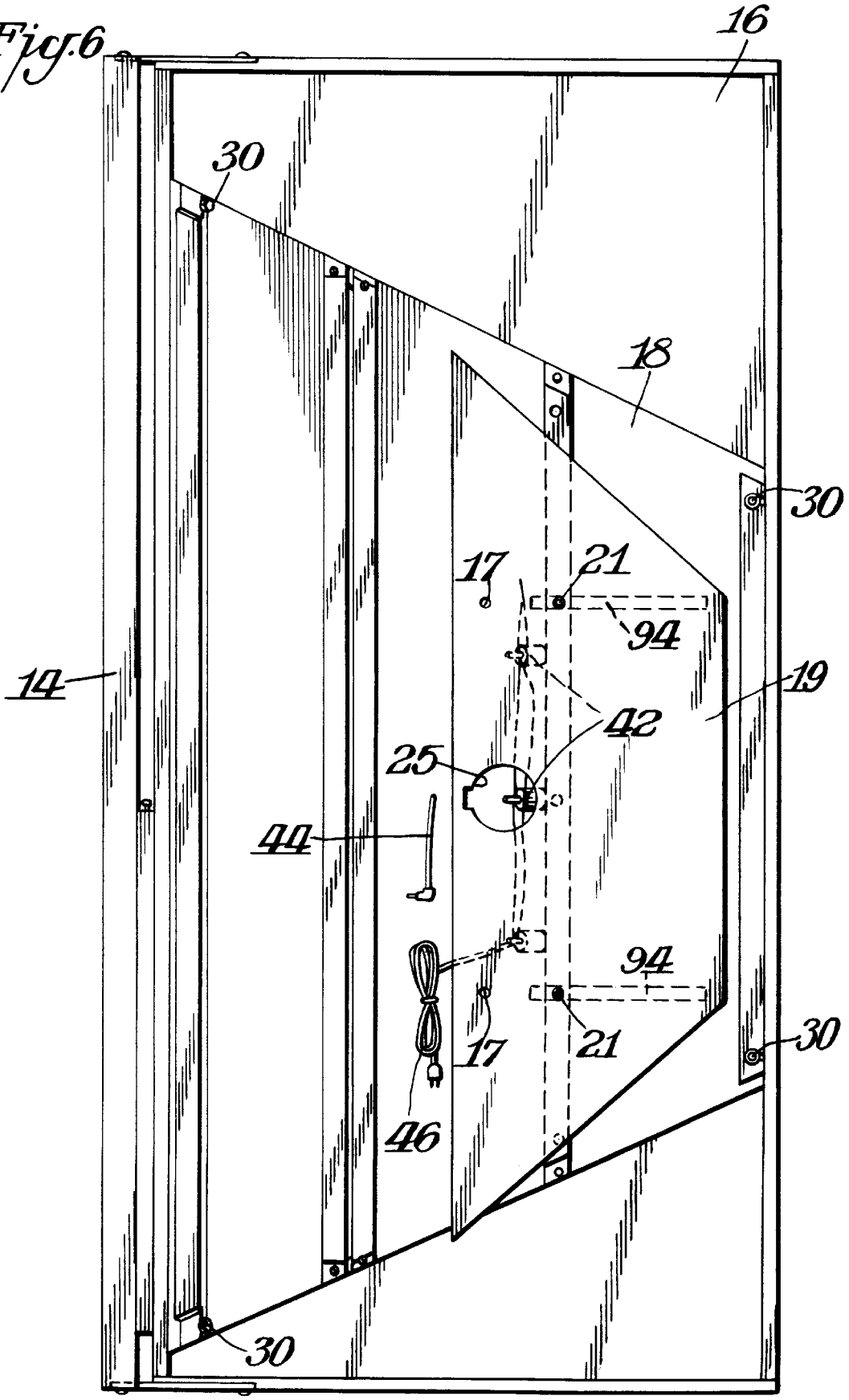
FIG. 6 is a front elevational view of the kiosk shown in FIGS. 4–5.

FIG. 6 illustrates details of the roof 18 when the kiosk 10 is in this partially assembled condition. As shown therein, roof 18 is secured to side or wing 16 by the various mounting bolts 30. Roof 18 also includes various electrical components such as indirect lamp lighting sockets 42, microphone cord 44 and electrical cord 46.

Light shield 19 would be detached from roof 18 by removing screws 21 which secure light shield 19 to a rib on the upper side of roof 18. Light shield 19 is then set aside. The four screws 30 that hold the roof 18 to the side panel 16 are then removed. The roof is then set aside.

Figure 7:
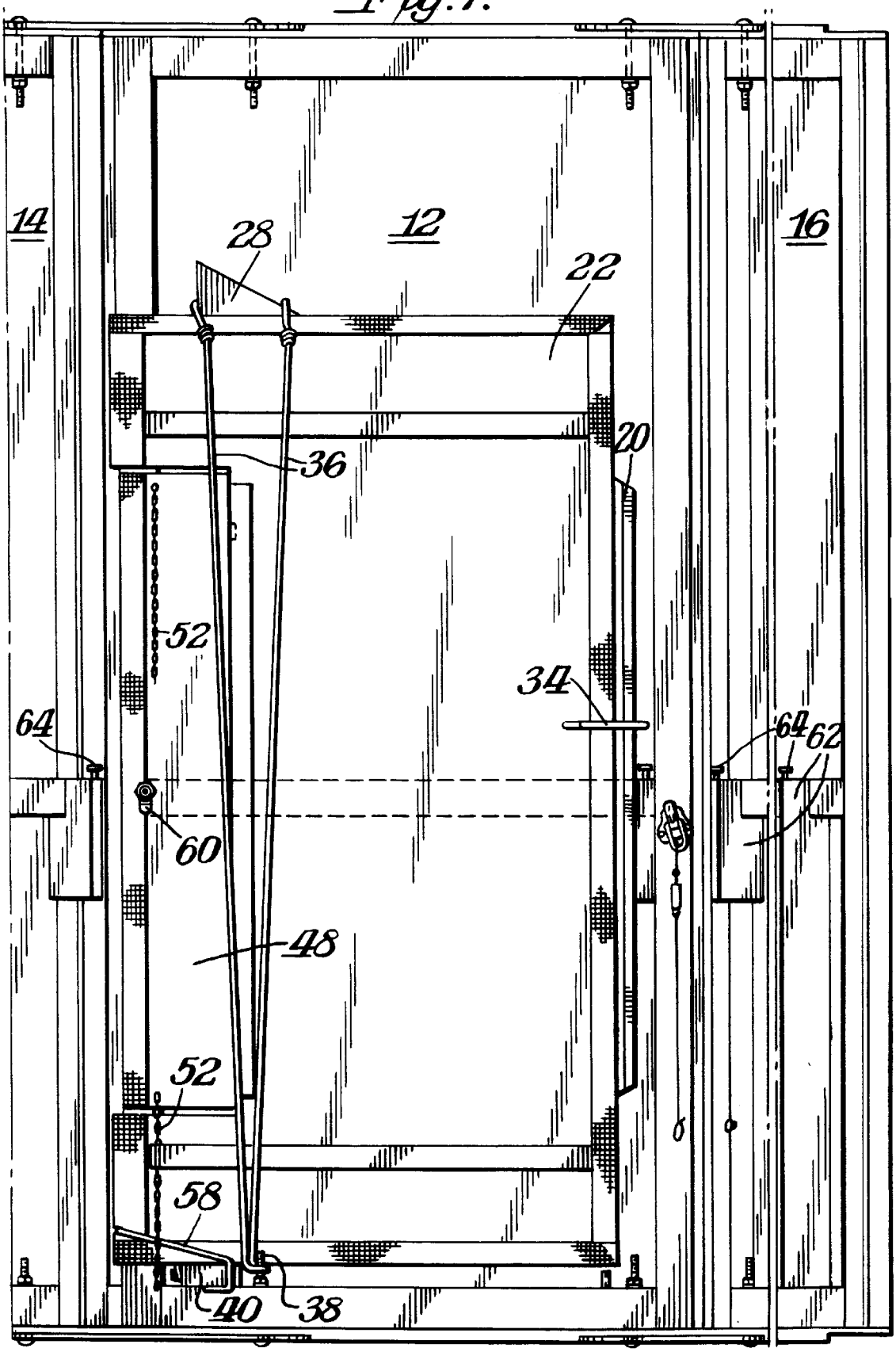
FIG. 7 is a front elevational view of the kiosk shown in FIGS. 1–6 in a further stage or assembly.

FIG. 7 illustrates the lower or front panel 22 which is mounted in front of floor 28. Front panel 22 includes a hinged support section 48 which will be used to support a keyboard as shown, for example, in FIGS. 22 and 23 which illustrate the computer monitor 50 mounted on support 48. Hinged support 48 is maintained in its horizontal position by chains 52 illustrated in FIGS. 7, 22 and 23. It is to be understood that other connectors, such as cords may be used instead of chains. As shown in FIGS. 22–23 the upper end of chain or connector 52 is mounted in one of the holes 54 in bracket 56 extending downwardly and connected to countertop 20.

FIG. 7 also shows the hinged support block 40 with U-shaped front panel clamp 58. A pivoted locking member 60 is provided on support 48 of front panel 22 to maintain the support in an upright position coplanar with the remaining portions of panel 22 so that when the kiosk is in its assembled condition, but not being used various material such as literature and other components could be stored in back of lower panel 22 and by having the support member 48 in its closed vertical position under lock 60 there is no access through the opening created when support 48 is in its horizontal position.

FIG. 7 also illustrates a plurality of countertop locator and support blocks 62 on the various walls to support the countertop in the assembled condition. Locator pins 64 are mounted on blocks 62.

Figure 8:
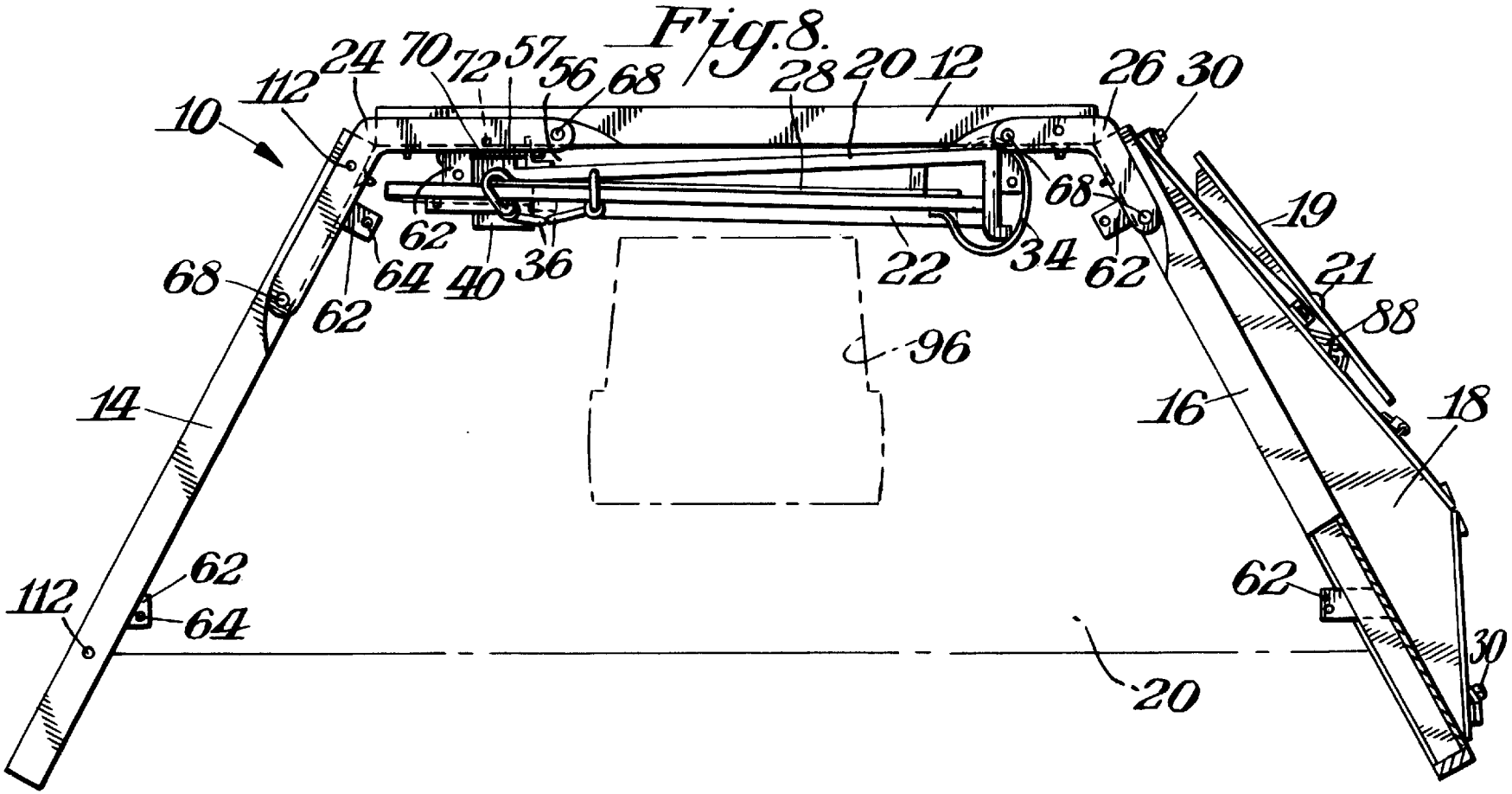
FIG. 8 is a top plan view of the kiosk shown in FIG. 7.

FIG. 8 shows the orientation of the various blocks 62 and locator pins 64 when the walls 12, 14, 16 are in their assembled condition.

FIGS. 15–16 show the placement of countertop 20 on the blocks 62 as properly positioned by pins 64 being located in holes or recesses 66 in the lower surface of countertop 20.

FIG. 8 also illustrates the function of hinges 24 and 26. The shorter hinge 26 connects back panel or wall 12 with side wall 16 which in the stored condition would be located closer to back wall 12 than side wall 14. Conversely, the longer hinge 24 permits the side wall 14 to be rotated parallel to walls 12 and 16 in the stored condition and spaced outwardly of those walls as illustrated, for example, in FIG. 3. The pivot pins 68 for each of the hinges is mounted inwardly from the actual corners where back wall 12 meets its corresponding side wall 14 or 16. This offset positioning of the pivot points in connection with the difference in length of the hinges assures the proper spaced parallel locations of the three walls.

FIG. 8 illustrates further fasteners used for mounting the lower panel 22 and floor 28 and countertop 20 in front of back panel 12. As shown therein a pin 70 extends through one of the mounting blocks 62 and passes through an eye 72 secured to floor 28. Pin 70 then extends through the L-shaped flange or plate 56 mounted to the lower edge of countertop 20. Pin 72 would pass through the hole 73 shown, for example, in FIG. 22.

In FIG. 8 the countertop 20 is shown in phantom and includes a cutout 96 for receiving the computer monitor 50.

Figure 9:
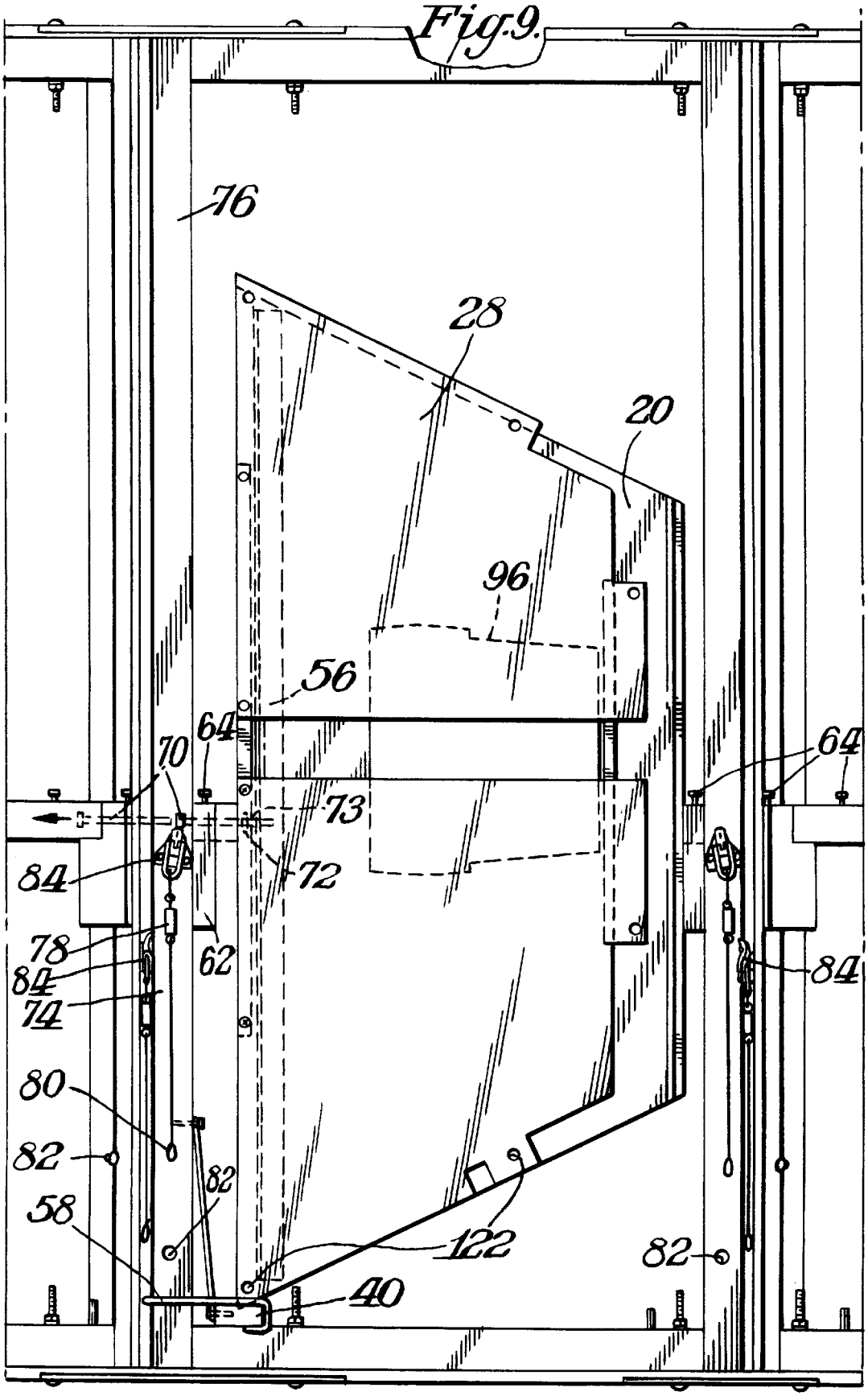
FIG. 9 is a front elevational view of the kiosk shown in FIGS. 1–8 in a still further stage of assembly.

FIG. 9 is a front elevational view showing the parts of kiosk 10 where both wings or side walls 14,16 have been rotated to the open position shown in FIG. 8. FIG. 9 illustrates sets of tension cords or chains 74 mounted to the studs 76 of back panel 12. A turn-buckle 78 is provided for each tension cord 74. As shown in FIG. 15 each remote end having the loop 80 would be secured to a pin, nail or other projection 82 on the side walls 14,16. By manipulating turn-buckle 78 the tension cord 74 becomes taut thereby assuring a firm mounting or positioning of each side wall with respect to the back wall. The anchored end of tension cord 74 is secured to studs 76 by clamps 84.

Figure 10:
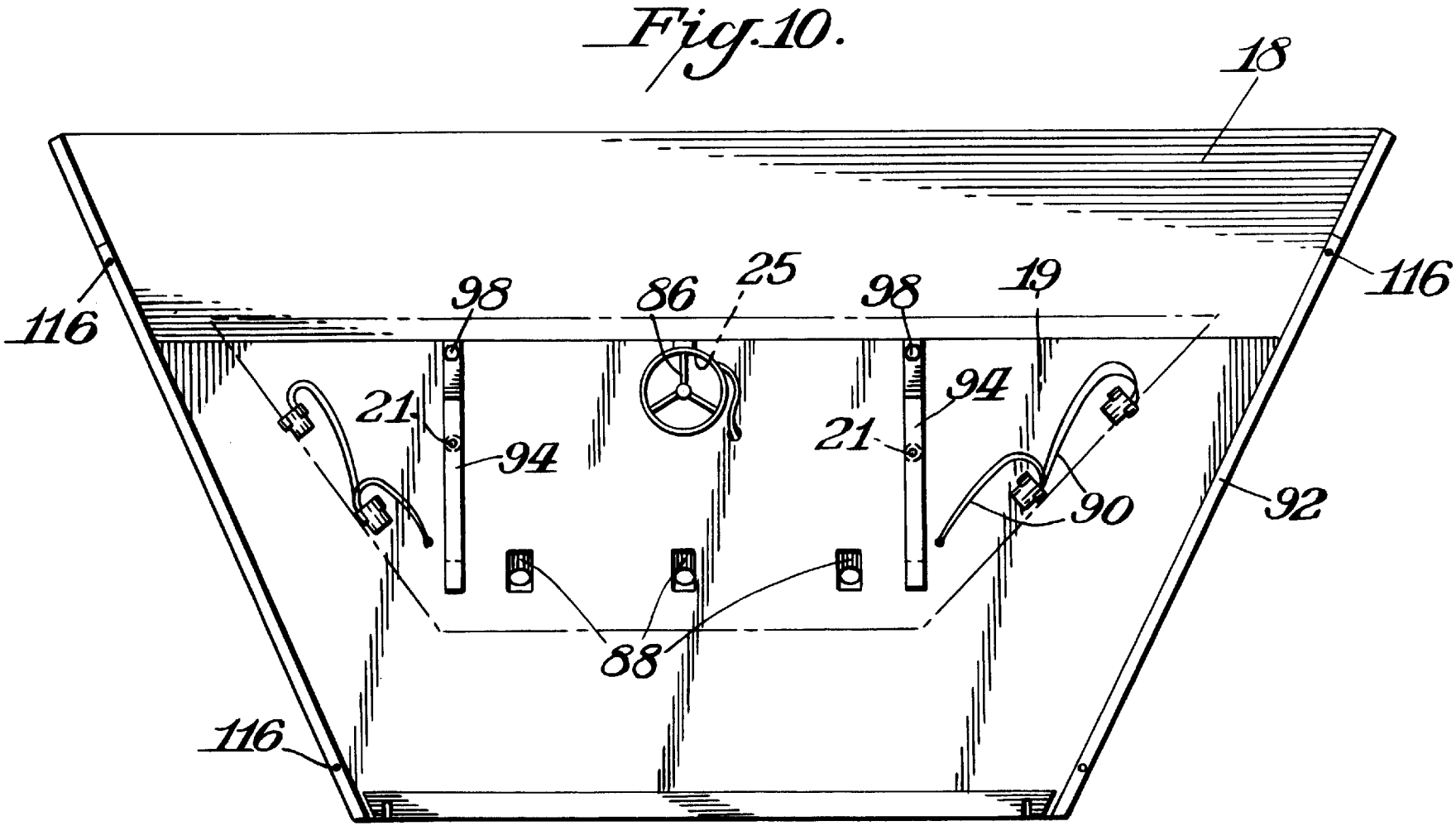
FIG. 10 is a bottom plan view of the kiosk roof in accordance with this invention.

FIG. 10 is a bottom plan view of the roof 18. As shown, a microphone 86 is mounted to the lower surface of roof 18. Various indirect lighting sockets 88 are also mounted to the undersurface of roof 18 for receiving the appropriate bulbs. Additionally, the necessary electrical wiring 90 would be provided which extends through the roof as also shown on the upper surface of roof 18 illustrated in FIG. 6. Roof 18 additionally includes V-shaped side frames 92 and support brackets 94. A bolt 98 extends from each bracket 94 as later described.

Figure 13:
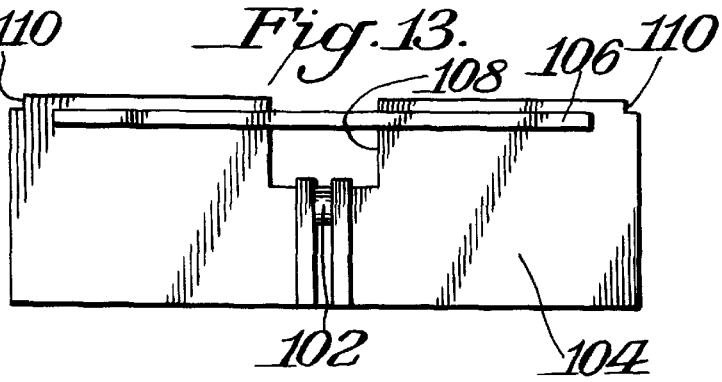
FIGS. 13–14 are top and bottom plan views of the lifter shown in FIGS. 11–12.
Figure 12:
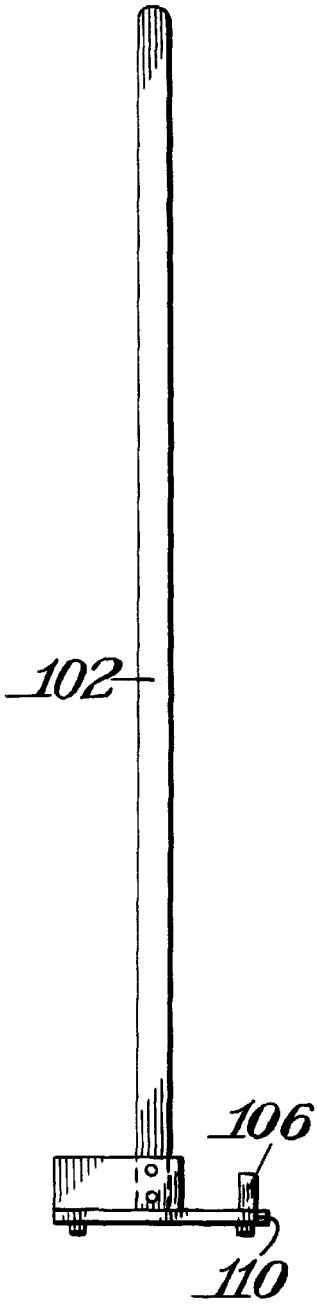
FIG. 12 is a right side elevational view of the lifter shown in FIG. 11.
Figure 11:
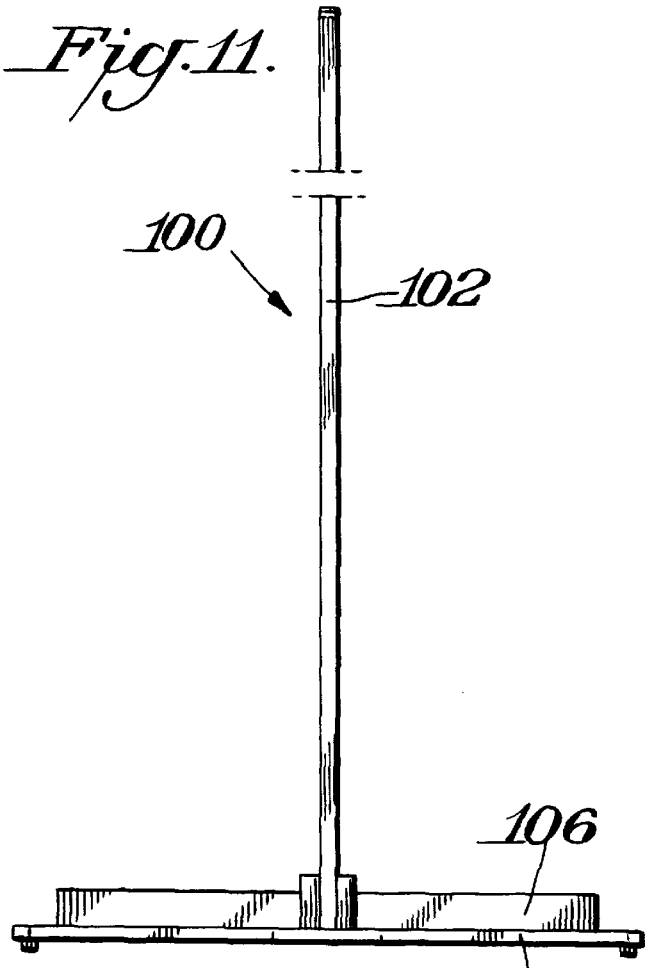
FIG. 11 is a front elevational view of a roof kicker or lifter used in assembling the roof on the kiosk in accordance with this invention.
Figure 14:
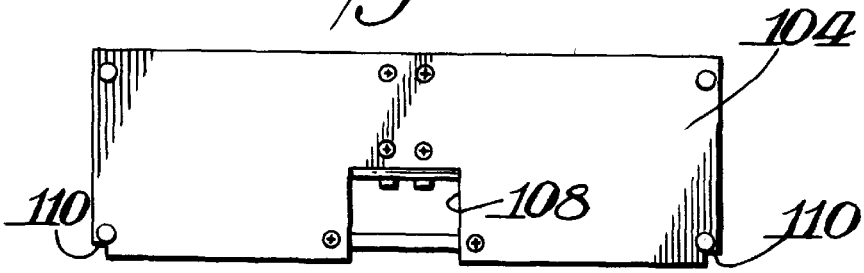

FIGS. 11–14 illustrate a roof mounting tool or lifter 100. Tool 100 includes an elongated handle 102 at the end of which is mounted a support plate 104. A reinforcing plate 106 is disposed against support plate 104. Support plate 104 has a cutout or notch 108 as shown in FIGS. 13–14 which would span the microphone 86 of roof 18. Corner notches 110 are provided on opposite corners of support plate 104.

FIG. 15 illustrates the kiosk 10 in its assembled condition before the roof is mounted on the top of the walls 12,14,16. As shown therein locating pins 112 are mounted on the upper edge of each wing or side wall 14,16. The pins 112 located closest to the back wall are located at the corresponding hinges. See FIG. 8.

FIGS. 19–19A show the sequence of steps in mounting the roof 18 to the top of the kiosk. The lightbulbs 23 are installed in the light sockets 88 of roof 18. Preferably three halogen mini-floods are in the sockets facing down and four tubular conventional bulbs in the angled side socket.

The light shield 19 which had been previously removed from roof 18 in the initial stages of assembly is now assembled to roof 18. The light shield 19 includes two holes 17 (see FIGS. 6 and 18) for fitting over bolts 98 secured to roof ribs 94. Light shield 19 also includes a large hole 25 which would fit over the microphone. The screws 21 that held light shield 19 to the top of the roof 18 fasten are then used to light shield 19 onto the stiffener ribs or brackets 94 on the underside of the roof. As noted, the provision of the light shield 19 below the bulbs 23 provides indirect lighting. The end of the light shield 19 closest to the back panel 12 is lower than the top of the panels 12,14,16 in order to clear the mini-flood lights. Cool thin lights with the right color spectrum may also be used. Light shield 19 further provides a ready means for having access to the bulbs should it be necessary to change the bulbs after the kiosk has been assembled by simply removing light shield 19 from the stiffener ribs 94. With this arrangement the lights generally do not undergo physical shocks that moving the kiosk might bring.

Light shield 19 is also secured to the underside of roof 18 by bolts 98 passing through the set of holes 17 which could be in addition to or as an alternative to screws 21 securing light shield 19 to ribs 94.

FIG. 19A illustrates the engagement of the lifter tool or kicker 100 wherein the notches 110 slide under the heads on bolts 98 extending downwardly from support brackets 94. As illustrated in FIG. 10 a set of two holes 116 is located in each downwardly extending side wall of roof 18 separated by a distance corresponding to the positioning of pins 112 on side walls 14,16. When notches 110 are engaged with bolts 98 while the roof is tilted against the kiosk as shown in solid lines in FIG. 19, the handle 102 can then be raised to elevate the roof to the position shown in phantom in the upper right hand portion of FIG. 19. The roof would then be positioned directly over the three walls 12,14,16 of kiosk 10 until the holes 116 are located directly above the corresponding pins 112. The roof is then lowered into place to firmly mount the roof on the side walls. The mounting of the roof on the side walls adds further stability to the kiosk.

FIGS. 15 and 17 further illustrate the provision of floor locking pins 118 on the horizontal studs 120 secured to the lower edge of side walls 14,16. Pins 118 would extend through corresponding holes 122 in floor 28 to assure proper positioning of floor 28. This mounting of floor 28 between the vertical studs 124 and on the horizontal studs 120 of the side walls further assures stability of the assembled kiosk.

FIG. 18 illustrates the kiosk in its stage of assembly before the roof 18 is to be lifted to be positioned on top of the walls 12,14,16.

FIGS. 20–21 show the manner of mounting front or lower panel 22 in its assembled position. As shown therein a plurality of fasteners such as screws 130 are mounted through panel 22 into the vertical studs 124 of the side panels. Similarly, fasteners 132 at the top edge of panels 22 are screwed into blocks 134 secured to L-shaped bracket 56. As shown in FIG. 21, L-shaped bracket 56 is spaced inwardly from flange 57 of countertop 22. As illustrated in FIG. 20 and other figures the hinged support bracket 48 of panel 22 does not extend as high as the outer portions of panel 22 when support bracket 48 is in its vertical position. The side extensions of panel 22 fit into the spacing between bracket 56 and flange 57 of countertop 20.

FIGS. 20–21 also illustrate the manner of mounting hinge support 48 in its vertical condition. As shown therein the lock 60 is rotated to the locking position.

FIG. 22 illustrates the kiosk 10 in its condition of use.

As shown therein horizontal support bracket 48 supports a keyboard 136. FIG. 22 also illustrates countertop 20 to have a vertical backplate 138 which includes the holes 32 so that speakers could be mounted behind back plate 138 in registry with holes 32. A speaker 33 could also be mounted high in the center or back panel 12. FIG. 22 also illustrates the microphone 86 at the top mounted to roof 18. If desired, an optional microphone 140 may be mounted at any suitable locations, such as countertop 120.

As previously described and as indicated by the cross hatching, the various vertical walls of kiosk 10 would have sound absorbing material, such as acoustic dampening fabric or foam. Countertop 20 and front panel 22 extend inwardly of the outer edges of side wall 14,16 so that there is space for users to enter the kiosk a nd be somewhat sheltered from other surroundings.

When it is desired to store the kiosk the reverse procedure is performed and the various components such as the front panel, floor, roof and countertop are mounted in the spaces provided between the spaced parallel walls 14,16. Only basic tools would be needed for assembly and disassembly such as a screwdriver. The stored components can be easily moved by, for example, a hand truck. Electronic equipment such as the computers would be detached and stored separately.

What is claimed:

1. A knock-down kiosk comprising a shell having a three wall construction with a completely open fourth wall whereby said open fourth wall comprises an open entrance into said shell, said three wall construction comprising a pair of side walls interconnected to a back wall, a countertop detachably mounted to said walls, a roof detachably mounted to and over said side walls and said back wall, each of side walls being connected to said back wall by a hinge structure which permits said walls to be disposed parallel to each other with spacings defined between adjacent said parallel walls when said kiosk is in a knock-down condition, and said spacings being of sufficient size to house said countertop and said roof to thereby dispose said kiosk in compact form during periods of storage and transportation; and said shell has a trapezoidal shape with a wide side of the trapezoidal shape being said open entrance, said side walls diverging away from said back wall, and said side walls and said back walls having a generally same size and shape.

2. The kiosk of claim 1 wherein said roof is completely detached from said side walls and from said back wall in said knock-down condition, and said roof being disposed between said walls in a shielded manner in said knock-down condition.

3. The kiosk of claim 1 wherein one of said side walls is disposed between said back wall and the other of said side walls when said kiosk is in said knock-down condition.

4. The kiosk of claim 1 including a floor detachably mounted to each of said walls, and said floor being of a size to fit in one of said spacings when said kiosk is in said knock-down condition.

5. The kiosk of claim 1 wherein said countertop is mounted to each of said side walls and said back wall, and said countertop terminating inwardly of said entrance to provide an open area between said entrance and said countertop within said shell.

6. The kiosk of claim 1 including acoustic dampening material on each of said side walls and said back wall.

7. A knock-down kiosk comprising a shell having a pair of side walls interconnected to a back wall with an open area between said side walls remote from said back wall to provide an entrance into said shell, a countertop detachably mounted to said walls, a roof detachably mounted to and over said side walls and said back wall, each of said side walls being connected to said back wall by a hinge structure which permits said walls to be disposed parallel to each other with spacings defined between adjacent said parallel walls when said kiosk is in a knock-down condition, said spacings being of sufficient size to house said countertop and said roof to thereby dispose said kiosk in compact form during periods of storage and transportation, said hinge structure comprising a large V-shaped hinge secured to one of said side walls and said back wall at a corner, wherein one of said side walls and back wall meet, and a smaller V-shaped hinge secured to the other side wall engaged with said back wall, and each of said hinges having a pivot point at said respective side walls.

8. The kiosk of claim 7 wherein said countertop is mounted to each of said side walls and said back wall and said countertop terminating inwardly of said entrance to provide an open area between said entrance and said countertop within said shell.

9. The kiosk of claim 7 including a lower panel mounted to said countertop and extending downwardly therefrom.

10. The kiosk of claim 9 wherein said lower panel includes a hinged support selectively movable to a horizontal supporting position and a vertical closed position, and locking structure for holding said support in said vertical closed position.

11. The kiosk of claim 7 wherein said roof has trapezoidal shape with a perimeter being of the same size and shape as the trapezoidal shaped shell formed by said side walls and said back wall, wherein said side walls having a top edge, and said roof secured to said top edge with fastening elements on said roof and side walls.

12. The kiosk of claim 11 wherein said roof comprises an underside a pair of ribs, support brackets each having an engaging member, a lifting tool having an elongated handle, a support plate secured at one end of said lifting tool handle, and a locking structure in support plate for engagement with said engaging members to couple said lifting tool with said roof and facilitate the mounting of said roof on said shell.

13. The kiosk of claim 7 wherein one of said side walls is disposed between said back wall and the other of said side walls when said kiosk is in said knock-down condition.

14. The kiosk of claim 13 including a floor detachably mounted to each of said walls, and said floor being of a size to fit in said one of said spacings when said kiosk is in said knock-down condition.

15. The kiosk of claim 14 including a lower panel mounted below said countertop in front of said floor remote from said back wall, and said lower panel being of a size to fit in one of said spacings when said kiosk is in said knock down condition.

16. The kiosk of claim 15 wherein said countertop is mounted to each of said side walls and said back wall, and said countertop terminating inwardly of said entrance to provide an open area between said entrance and said countertop within said shell.

17. The kiosk of claim 16 wherein said lower panel includes a hinged support selectively movable to a horizontal supporting position and a vertical closed position, and locking structure for holding said support in said vertical closed position.

18. The kiosk of claim 17 wherein said roof has a trapezoidal shape with a perimeter being of the same size and shape as the trapezoidal-shaped shell formed by said side walls and said back wall, wherein said side walls having a top edge, and said roof secured to said edge with fastening elements on said roof and side walls.

19. The kiosk of claim 18 wherein said roof comprises an underside a pair of ribs, support brackets each having an engaging member, a lifting tool having an elongated handle, a support plate secured at one end of said lifting tool handle, and a locking structure in support plate for engagement with said engaging members to couple said lifting tool with said roof and facilitate the mounting of said roof on said shell.

20. The kiosk of claim 19 including lighting members mounted to said underside of said roof, and a light shield mounted to said roof below said lighting members to provide indirect lighting to the interior of said kiosk.

21. The kiosk of claim 20 including a multimedia display screen mounted on said countertop, a computer keyboard mounted on said countertop, and audio structure mounted to the underside of said roof.

22. The kiosk of claim 21 including tensioning members mounted to said back wall.

23. The kiosk of claim 22 wherein said countertop includes a flange extending downwardly from a forward edge, wherein a bracket is mounted to an underside of said countertop.

24. The kiosk of claim 23 including spaced speakers mounted in said kiosk.

25. The kiosk of claim 24 including acoustic dampening material on each of said side walls and said back wall.

26. The kiosk of claim 25 including a pair of support blocks on each of said side walls and said back wall, wherein said countertop is mounted on said support blocks, and each of said support blocks having a pin located in a corresponding recess in a lower surface of said countertop.

27. The kiosk of claim 25 including a plurality of retainer plates attached to said walls when said kiosk is in said knock down condition to prevent said walls from moving relative to each other.

28. The kiosk of claim 27 wherein each of said retainer plates has a triangular shape, a fastener receiving hole at each corner of each retainer plate with three holes, and a fourth fastening receiving hole along an edge of said plate opposite one of said three holes.

29. The kiosk of claim 28 including cords and anchor members mounted at said panel and said floor and said countertop for holding said panel and said floor and said countertop together.

30. The kiosk of claim 7 wherein said shell has a trapezoidal shape with a wide side of the trapezoid being said open entrance, said side walls diverging away from said back wall, and said side walls and said back wall having a generally same size and shape.

31. A knock-down kiosk comprising a shell having a pair of side walls interconnected to a back wall with an open area between said side walls remote from said back wall to provide an entrance into said shell, each of said side walls and said back wall having a lower edge, a platform located a sufficient distance above said lower edge to comprise a countertop, said countertop being detachably mounted to said walls a substantial distance above said lower edges, a roof detachably mounted to and over said side walls and said back wall, each of said side walls being connected to said back wall by a hinge structure which permits said walls to be disposed parallel to each other with spacings defined between adjacent said parallel walls when said kiosk is in a knock-down condition, and said spacings being of sufficient size to house said countertop and said roof to thereby dispose said kiosk in compact form during periods of storage and transportation.

32. The kiosk of claim 31 wherein a floor is mounted to said side walls and said back wall below and spaced from said countertop.

* * * * *